United States Patent [19]

Ivosevic

[11] 4,118,156

[45] Oct. 3, 1978

[54] FUEL INJECTION PUMP HAVING CHOKE MEANS IN OVERFLOW LINE

[75] Inventor: Strahinja Ivosevic, Winterthur, Switzerland

[73] Assignee: Sulzer Brothers Limited, Winterthur, Switzerland

[21] Appl. No.: 746,426

[22] Filed: Dec. 1, 1976 (Under 37 CFR 1.47)

[51] Int. Cl.[2] ..... F04B 7/04; F04B 39/10

[52] U.S. Cl. ..... 417/494; 123/139 AA

[58] Field of Search ..... 417/500, 499, 494, 492, 417/296, 289; 123/139 AD, 139 BD, 139 AA

[56] References Cited

U.S. PATENT DOCUMENTS

| | | | |
|---|---|---|---|
| 2,178,902 | 11/1939 | Clausen | 123/139 AD |
| 2,496,804 | 2/1950 | Meitzler | 417/500 |
| 3,609,070 | 9/1971 | Bagshaw | 417/499 |
| 3,910,724 | 10/1975 | Okamoto | 417/500 |
| 3,963,384 | 6/1976 | Bastenhof | 417/499 |

FOREIGN PATENT DOCUMENTS

| | | | |
|---|---|---|---|
| 690,563 | 4/1953 | United Kingdom | 417/494 |

*Primary Examiner*—Carlton R. Croyle
*Assistant Examiner*—Thomas I. Ross
*Attorney, Agent, or Firm*—Kenyon & Kenyon, Reilly, Carr & Chapin

[57] ABSTRACT

The inlet of the fuel overflow line of the injection pump is provided with a choke means having at least two choke points disposed in series while a shut-off means is provided for the fuel feed line to prevent a pressure wave from entering the feed line during overflow. Various embodiments are described to show the choke means and shut-off means in separate lines, in parallel in the feed line or within each other in the feed line.

6 Claims, 7 Drawing Figures

1
3
14
20
25
14'
23'
d3
24'
d2
d1
d4
25'
20'
21'
18
17'
15
16
2
4
5
6
7
8
10
11
12
13
A

FUEL INJECTION PUMP HAVING CHOKE MEANS IN OVERFLOW LINE

This invention relates to a fuel injection system for a diesel engine.

As is known, fuel injection systems for diesel engines generally include a pump which has a pump piston with control edges for controlling the start and the end of an injection process. Usually, these control edges cooperate with control ports in a wall of the pump cylinder which open into a collecting chamber surrounding the cylinder. In addition, a feed line from a feed pump usually connects to the collecting chamber to supply fuel while an overflow pipe is provided for receiving the fuel which overflows when the injection process is terminated. Where these fuel injection systems are used in cases where high injection pressures occur, e.g. in supercharged Diesel engines, particularly Diesel engines for ship propulsion, damage due to cavitation occurs at the surface of the piston as well as at the surfaces of the control ports and control edges. Generally, the damage at the surface extends essentially parallel to and at some distance from the control edge and can lead to rapid destruction of the pump. In spite of various attempts, it has not been possible to date to eliminate this cavitation.

Accordingly, it is an object of the invention to provide a fuel injection system in which the above type of cavitation is eliminated.

It is another object of the invention to provide a simple means for eliminating cavitation in a fuel injection system at high injection pressures.

Briefly, the invention provides an injection fuel system which comprises an injection pump having a fuel collecting chamber, a feed line for delivering a flow of fuel to the collecting chamber, an overflow line for receiving an overflow of fuel, a choke means and a shut-off means. The choke means has at least two choke points disposed in series and is located in an input of the overflow line. The shut-off means serves to prevent a pressure wave produced during overflow from entering the feed line.

The cooperation of the choke means and the shut-off means prevents any high velocity fuel jet from occurring at the termination of the injection process; which jet would otherwise result in the generation of underpressure regions in which gas bubbles which lead to cavitation can form. In this connection, a single choke point has been found to be ineffective since insufficient turbulence of the overflowing fuel occurs even if the flow resistance of the choke point is high.

The shut-off means for preventing the pressure wave from entering the feed line may be a check valve particularly in the case of pumps in which the overflow passes into the collecting chamber of the feed line. In this case, the overflow can pass either back into the feed line or into an overflow pipe connected to the collecting chamber.

However, the shut-off means may also be an annular wall which separates the collecting chamber to which the feed line is connected from a separate collecting chamber for the overflow of the fuel. The annular wall, however, must surround the cylinder to form a tight seal in such a manner that the pressure wave cannot pass between the annular wall and the outer cylinder wall.

The choke means may contain three choke points with the respective flow apertures being of increasing cross-sectional area in the flow direction. For the present purpose, an optimum ratio of energy dissipation due to turbulence to the flow resistance exists.

The fuel injection system may be constructed so that the fuel feed line also serves as the overflow line. In this case, the feed line and overflow line are embodied in a single pipe. In addition, the shut-off means may be in the form of a check valve with the choke means within the valve body of the check valve. In this case, the check valve is disposed at that end of the feed line which is connected to the injection pump. In this manner, a simple system is obtained which meets the requirements regarding freedom from cavitation.

These and other objects and advantages of the invention will become more apparent from the following detailed description and appended claims taken in conjunction with the accompanying drawings in which:

Figure 1:
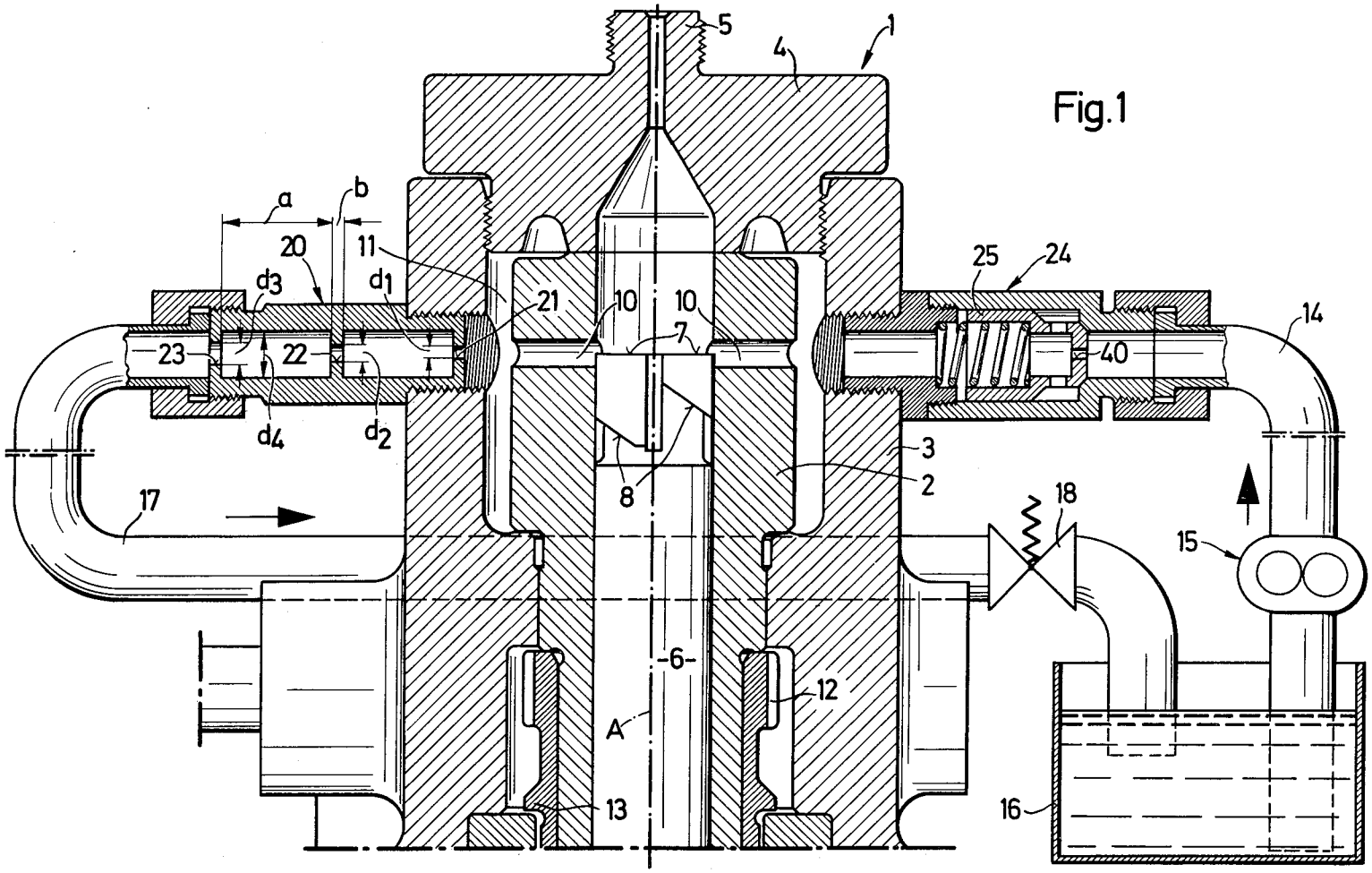
FIG. 1 illustrates a partial cross sectional view of a first embodiment of a fuel injection system according to the invention with a schematic of the connecting line.

Referring to FIG. 1, a fuel injection pump 1 of a Diesel engine, and in particular, of a large supercharged Diesel engine, contains a cylinder 2 which is secured in a housing 3 and defines an injection chamber. The cylinder 2 is closed off by a cover 4 which has a connection 5 for a fuel line which leads to an injection valve (not shown) located in a working cylinder of the engine. The pump 1 also has a piston 6 which is reciprocally mounted in the cylinder 2 in a known manner by a cam (not shown) to execute a suction stroke and a working stroke each time. The piston 6 has upper control edges 7 for controlling the start of the injection process as well as inclined lower control edges 8 by means of which the end of the injection process is controlled. The control edges 7, 8 cooperate with a plurality of control ports 10 in the cylinder 2 which communicate the injection chamber of the cylinder 2 to an annular collecting chamber 11 which surrounds the cylinder 2.

The control edges 7, 8 are symmetrical at the piston 6 in a known manner so that lateral loading of the piston 6 by hydraulic pressures is avoided. The piston 6 is also rotatable about its axis A in a known manner by means of a rack (not shown) which meshes with teeth 12 on a part 13 connected to the piston 6 below the cylinder 2. This allows the end of the injection process and, thereby, the effective stroke of the piston 6 to be influenced by means of the inclined control edges 8.

A fuel feed line 14 is connected to the collecting chamber 11 and a feed pump 15 is located in the feed line 14 to pump fuel from a tank 16 through the line 14 to the collecting chamber 11. An overflow pipe 17 which has a pressurizing valve 18 for determining the feed pressure of the pump 15 prevailing in the collecting chamber 11, leads from the collecting chamber 11 back into the tank 16.

The overflow pipe 17 is equipped with a choke means 20 which contains three choke points 21, 22, 23 in series while a shut-off means in the form of a check valve 24 with a spring-loaded valve body 25 is inserted into the feed line 14. As shown, the choke points 21, 22, 23 are formed by disks which have flow apertures of increasing cross-sectional area in the flow direction.

Figure 2:
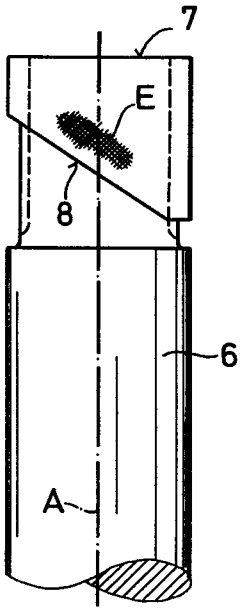
FIG. 2 illustrates a partial view of a piston of the pump according to FIG. 1.

Referring to FIG. 2, the damage due to cavitation which would otherwise occur in the injection pumps of the type without the choke means 20 and check valve 24 is exhibited in the form of erosion areas E which extend substantially parallel to the control edge 8. In addition, the control edges 8 and the edges of the openings 10 are damaged. However, use of the choke means 20 and check valve 24 eliminates cavitation in these areas.

When the fuel pump 1 (FIG. 1) pumps fuel, a sharp jet, which flows with high velocity into the parts 10, is formed when the piston control edges 8 reach the ports 10. In the previously known pumps, this jet results in a pressure drop in the fuel which leads to the cavitation phenomena described. The choke means 20, however, prevents a pressure drop below the vapor pressure of the fuel at the instance of overflowing, as the feed line 14 is shut off to the pressure wave by the check valve 24. The overflowing fuel is made turbulent by the choke device 20, so that the flow energy of the fuel is dissipated without major pressure shocks.

The valve body 25 of the check valve 24 may also have a choke aperture 40. This choke aperture 40 serves as an artificial leak for the check valve 24 and is so small that the pressure wave produced by an overflow process is prevented from entering the fuel line 14. In this way, the development of cavitation phenomena due to fast closing of the check valve 24 is prevented.

Figures 3, 4:
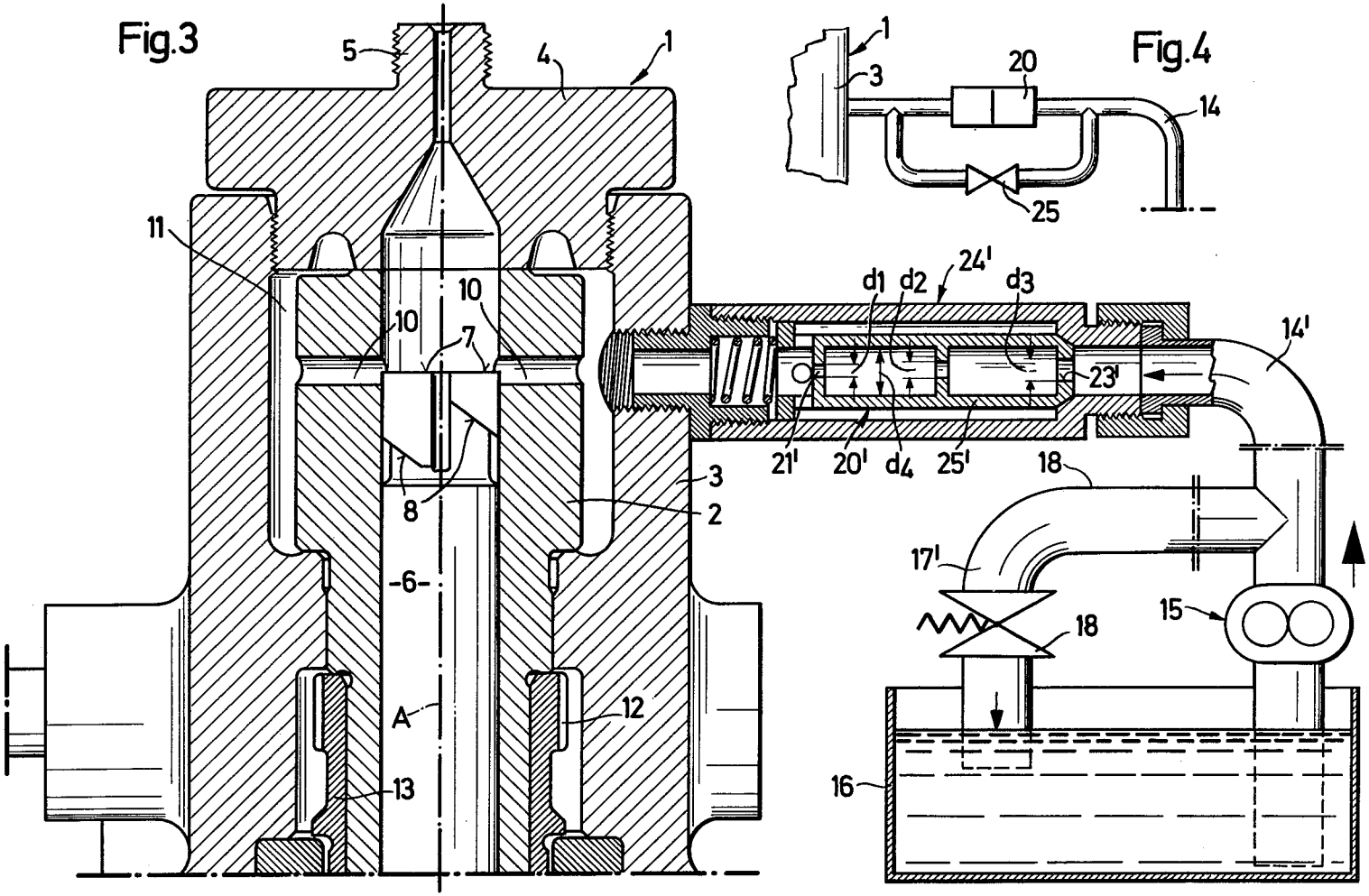
FIG. 3 illustrates a cross-sectional corresponding to FIG. 1 of a system with a single line which serves as a feed line and overflow line in accordance with the invention.
FIG. 4 illustrates a schematic of another embodiment of the feed line of the pump as per FIG. 3 according to the invention.

Referring to FIG. 3, wherein like reference characters indicate like parts as above, the feed line 14 may also serve as the overflow line. In this embodiment, a line 17' which contains the pressurizing valve 18 is connected in parallel to the feed pump 15. In addition, a check valve 24', a valve body 25' of which is combined with a choke means 20', is arranged at the end of the feed line 14 adjacent the injection pump 1. This choke means 20' contains three choke points 21', 22', 23' disposed in series in the overflow fluid flow path.

During operation, if the valve body 25' is raised the fed-in fuel passes from the feed line 14 into the collecting chamber 11 and through the ports 10 into the pump injection chamber. During the transfer process, the pressure wave produced thereby closes the check valve 24' so that the transferred fuel must flow through the coke apertures 21', 22', 23' of the choke means 20'.

Referring to FIG. 4, the injection system of FIG. 3 may be modified so that the choke means 20 and the check valve 25 are connected in parallel and are not combined with each other. In this case, no overflow line as such is used.

Figure 5:
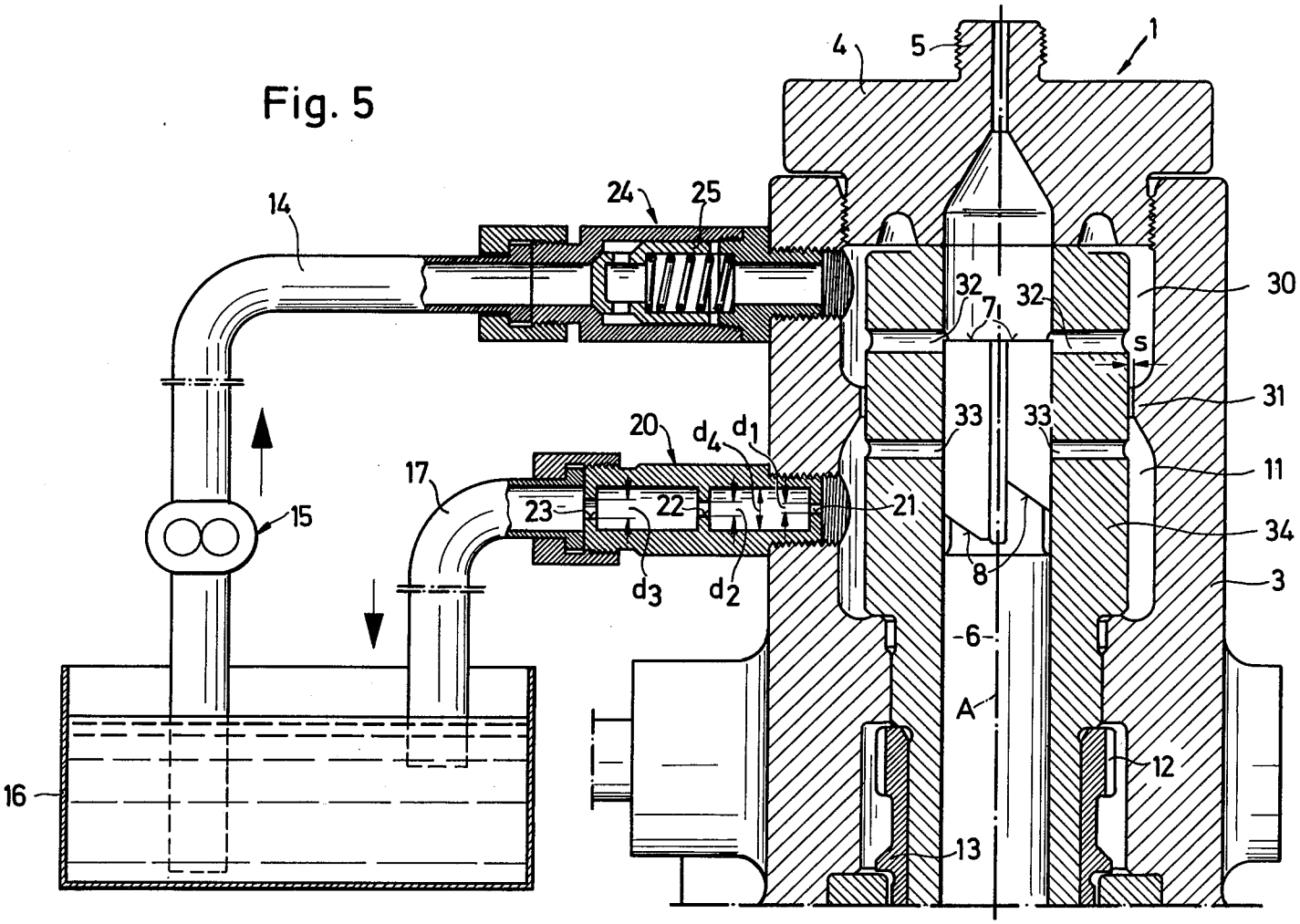
FIG. 5 illustrates a schematic view of another embodiment according to the invention corresponding to FIG. 1 of a pump with separate feed ports and overflow ports in the cylinder which lead to collecting chambers which are not tightly sealed relative to each other.

Referring to FIG. 5, wherein like reference characters indicate like parts as above, the injection pump 1 may have a second fuel collecting chamber 30 for the feed line 14 separate from the collecting chamber 11 for the overflow line 17. The collecting chambers 11, 30 are separated from each other by an annular separating wall 31 which, however, does not provide perfect sealing relative to the cylinder 34, as indicated by the depicted gap S. The piston 6 has control edges 7, 8 which cooperate with feed portsion 32 and overflow ports 33 in the cylinder 34. The feed line 14 is connected to the collecting chamber 30 in the same manner as in FIG. 1 via a check valve 24 with a spring-loaded valve body 25. The overflow line 17 is connected to the collecting chamber 11 via the choke means 20 without a pressurizing valve.

Figure 6:
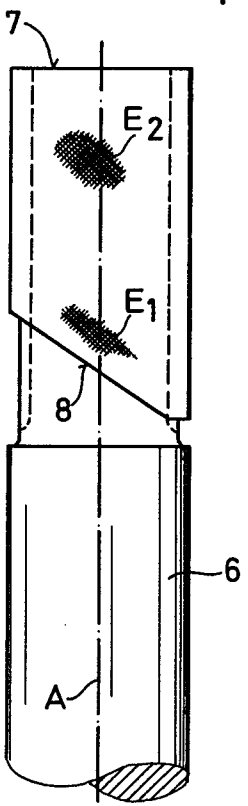
FIG. 6 illustrates a view of the piston of the pump as per FIG. 5.

FIG. 6 shows a view of the piston 6 of the system of FIG. 5 which shows the damage occurring in the previously known pumps. In this case, the piston is damaged by cavitation at two areas E1, E2. The two areas are determined by the mutual position of the ports 32 and 33.

The operation of the fuel pump as per FIG. 5 is substantially the same as already described in connection with FIG. 1. However, there is a separation between the inflowing and overflowing fuel, for which purpose the separate collecting chambers 11, 30 are provided. As the annular wall 31 does not act as a tight seal for pressure waves with high pressures, the check valve 24 must be arranged in the feed line 14. The check valve prevents the pressure wave from propagating and, thus, the development of cavitation.

Figure 7:
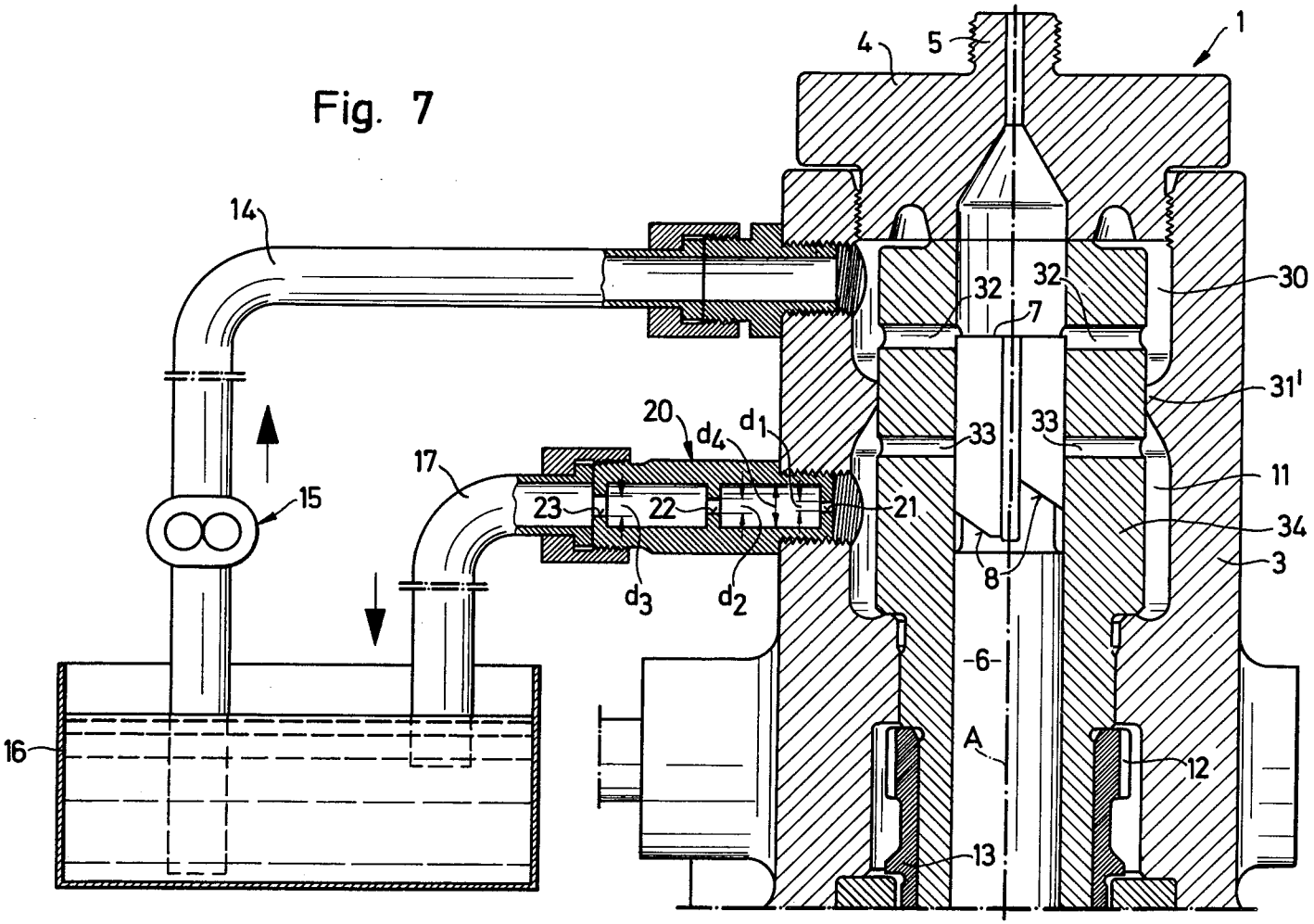
FIG. 7 illustrates a partial cross-sectional view corresponding to FIG. 5 of a pump according to the invention in which the collecting chambers of the feed line and the overflow line are separated from each other in a tight manner.

FIG. 7 finally shows an embodiment of the fuel injection pump according to FIG. 5 for the case where the annular wall 31 surrounds the cylinder 34 so as to form a tight seal for the pressure wave. In this case, the check valve 24 of FIG. 5 can be omitted so that the feed line 14 is connected directly to the annular chamber 30. Achieving a tight seal by means of the annular wall 31, however, is extremely difficult as the bores in the housing 3 and the cylindrical outer surfaces of the cylinder 34 must be made concentric with very narrow tolerances.

Referring to FIG. 1, for purposes of a numerical example, the fuel injection pump has a piston 6 of a diameter of 26 millimeters (mm), intended for a two-cycle engine with a piston diameter of 400 millimeters (mm) and an operating speed of revolution of 380 RPM (maximum pump pressure about 100 bar). The choke means 20 has the following dimensions:

The choke points 21, 22, 23 have diameters $d1 = 4.5$ mm, $d2 = 5.5$ mm, $d3 = 6.8$ mm; the choke disks are 3 mm thick ($b$ in FIG. 1) and are spaced at a spacing $a$ of 31 mm from each other; and the diameter $d4$ of the chambers between the choke points is 14 mm. The valve body 25 of the check valve 24 has a choke aperture 40 with a diameter of 2 millimeters (mm).

What is claimed is:

1. A fuel injection system for a diesel engine comprising an injection pump having a cylinder, defining an injection chamber, a fuel collecting chamber surrounding said cylinder, a plurality of control ports in said cylinder to communicate said collecting chamber with said injection chamber, a piston reciprocally mounted in said cylinder, said piston having control edges cooperating with said control ports to control a start and an end of an injection process;

a feed pump for pumping fuel;

a feed line between said feed pump and said collecting chamber for delivering a flow of pumped fuel to said collecting chamber;

an overflow line for receiving an overflow of fuel from said injection pump;

a choke means having three choke points disposed in series and being located in an input of said overflow line, said choke points having respective flow apertures of increasing cross-sectional area in the flow direction; and a shut-off means for preventing a pressure wave produced during overflow from entering said feed line.

2. A fuel injection system as set forth in claim 1 wherein said shut-off means is a check valve.

3. A fuel injection system as set forth in claim 1 wherein said injection pump includes a second fuel collecting chamber surrounding said cylinder and connected to said overflow line and wherein said shut-off means is an annular wall surrounding said cylinder to separate said fuel collecting chambers from each other.

4. A fuel injection system as set forth in claim 1 wherein said feed line and said overflow line are embodied in a single pipe.

5. A fuel injection system comprising an injection pump having a cylinder defining an injection chamber, a fuel collecting chamber surrounding said cylinder, a plurality of control ports in said cylinder to communicate said collecting chamber with said injection chamber, a piston reciprocally mounted in said cylinder, said piston having control edges cooperating with said control ports to control a start and an end of an injection process;

a feed pump for pumping fuel;

a feed line between said feed pump and said collecting chamber for delivering a flow of pumped fuel to said collecting chamber;

a check valve in said feed line for preventing a pressure wave from entering said feed line from said collecting chamber; and a choke means within said check valve and said feed line, said choke means having at least two choke points disposed in series in an overflow fluid flow path.

6. A fuel injection system comprising an injection pump having a cylinder defining an injection chamber, a fuel collecting chamber surrounding said cylinder, a plurality of control ports in said cylinder to communicate said collecting chamber with said injection chamber, a piston reciprocally mounted in said cylinder, said piston having control edges cooperating with said control ports to control a start and an end of an injection process;

a feed pump for pumping fuel;

a feed line between said feed pump and said collecting chamber for delivering a flow of pumped fuel to said collecting chamber;

a check valve in said feed line for preventing a pressure wave from entering said feed line from said collecting chamber; and a choke means in parallel with said check valve in said feed line, said choke means having at least two choke points disposed in series in an overflow fluid flow path.

* * * * *